US010330104B2

(12) United States Patent
Son et al.

(10) Patent No.: US 10,330,104 B2
(45) Date of Patent: Jun. 25, 2019

(54) AIR CONDITIONER

(71) Applicant: LG Electronics Inc., Seoul (KR)

(72) Inventors: Sanghyuk Son, Seoul (KR); Jeongtaek Park, Seoul (KR); Jieun Choi, Seoul (KR); Kyoungho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 271 days.

(21) Appl. No.: 15/338,153

(22) Filed: Oct. 28, 2016

(65) Prior Publication Data

US 2017/0122329 A1 May 4, 2017

Related U.S. Application Data

(60) Provisional application No. 62/248,463, filed on Oct. 30, 2015.

(30) Foreign Application Priority Data

Nov. 7, 2015 (KR) ..... 10-2015-0156254
Dec. 24, 2015 (KR) ..... 10-2015-0186044

(51) Int. Cl.

| | |
|---|---|
| ***F04D 25/08*** | (2006.01) |
| ***F04D 29/68*** | (2006.01) |
| ***F04D 29/28*** | (2006.01) |
| ***F04D 29/44*** | (2006.01) |
| ***F24F 6/16*** | (2006.01) |

(Continued)

(52) U.S. Cl.

CPC ..... *F04D 25/08* (2013.01); *F04D 17/16* (2013.01); *F04D 29/281* (2013.01); *F04D 29/4226* (2013.01); *F04D 29/444* (2013.01); *F04D 29/681* (2013.01); *F04D 29/701* (2013.01); *F24F 1/0025* (2013.01); *F24F 6/16* (2013.01); *F05D 2240/121* (2013.01);

(Continued)

(58) Field of Classification Search

CPC ..... F05D 2240/121; F05D 2240/122; F05D 2240/124; F05D 2250/52; F04D 25/08; F04D 29/681; F04D 29/4226; F04D 29/701; F04D 29/703

USPC ..... 415/208.2, 211.2

See application file for complete search history.

(56) References Cited

U.S. PATENT DOCUMENTS 7,618,236 B2 * 11/2009 Hsu ..... F04D 29/542 415/121.2
2014/0000852 A1 * 1/2014 Kim ..... F24F 7/007 165/121

(Continued)

FOREIGN PATENT DOCUMENTS

CN 103185028 A 7/2013
DE 3603112 A1 8/1987

(Continued)

*Primary Examiner* — Nathaniel E Wiehe
*Assistant Examiner* — Muhammed K Raji
(74) *Attorney, Agent, or Firm* — Dentons US LLP

(57) ABSTRACT

Provided is an air conditioner. The air conditioner includes: a blower fan blowing air; a blower motor rotating the blower fan; and a blower housing coupled with the blower motor and including a ring-shaped air blowing flow passage in which air discharged from the blower fan flows. Here, the blower housing includes a plurality of vanes that are disposed spaced from each other in a circumferential direction on the air blowing flow passage over the blower fan.

17 Claims, 18 Drawing Sheets

(51) Int. Cl.

| | |
|---|---|
| ***F24F 1/0025*** | (2019.01) |
| ***F04D 17/16*** | (2006.01) |
| ***F04D 29/42*** | (2006.01) |
| ***F04D 29/70*** | (2006.01) |

(52) U.S. Cl.
CPC .. *F05D 2240/122* (2013.01); *F05D 2240/124* (2013.01); *F05D 2250/52* (2013.01)

(56) References Cited

U.S. PATENT DOCUMENTS

2015/0115481 A1* 4/2015 Jang ..... F24F 6/16
261/24
2015/0292508 A1* 10/2015 Ikeda ..... F04D 29/283
415/208.2

FOREIGN PATENT DOCUMENTS

| | | | |
|---|---|---|---|
| EP | 2 860 464 | A1 | 4/2015 |
| GB | 1160136 | A | 7/1969 |
| JP | 5758814 | B2 | 8/2015 |
| KR | 10-2012-0028707 | A | 3/2012 |
| KR | 10-1392092 | B1 | 5/2014 |
| KR | 10-1510610 | B1 | 4/2015 |
| KR | 10-2015-0105105 | A | 9/2015 |
| WO | 2012/091369 | A2 | 7/2012 |

* cited by examiner

AIR CONDITIONER

CROSS-REFERENCE TO RELATED APPLICATIONS

This application claims the benefit of U.S. Provisional Patent Application No. 62/248,463, filed on Oct. 30, 2015, Korean Patent Application No. 10-2015-0156254 filed on Nov. 7, 2015, and Korean Patent Application No. 10-2015-0186044 filed on Dec. 24, 2015 which are incorporated herein by reference for all purposes as if fully set forth herein.

BACKGROUND OF THE INVENTION

The present invention disclosed herein relates to an air conditioner, and more particularly, to an air conditioner that upwardly guides air obliquely discharged from a blower.

An air conditioner is an apparatus that changes the interior space into a pleasant environment by allowing air to flow and thus cooling, heating, purifying or humidifying air. When this air conditioner admits air from a lower side and discharges air to an upper side, it is necessary that air smoothly flow from the lower side to the upper side inside the air conditioner.

SUMMARY OF THE INVENTION

The present invention provides an air conditioner which upwardly guides air obliquely discharged from a blower.

The present invention also provides an air conditioner which reduces noise and vibration while maximizing an air volume.

The objectives of the present invention are not limited to the above-mentioned objectives, and other objectives that are not mentioned will be clearly understood by persons skilled in the art from the following description.

Embodiments of the present invention provide air conditioners including: a blower fan blowing air; a blower motor rotating the blower fan; and a blower housing coupled with the blower motor and including a ring-shaped air blowing flow passage in which air discharged from the blower fan flows, wherein the blower housing includes a plurality of vanes that are disposed spaced from each other in a circumferential direction on the air blowing flow passage over the blower fan.

In some embodiments, each of the plurality of vanes may include a plurality of ribs formed on one surface thereof in an air flow direction.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
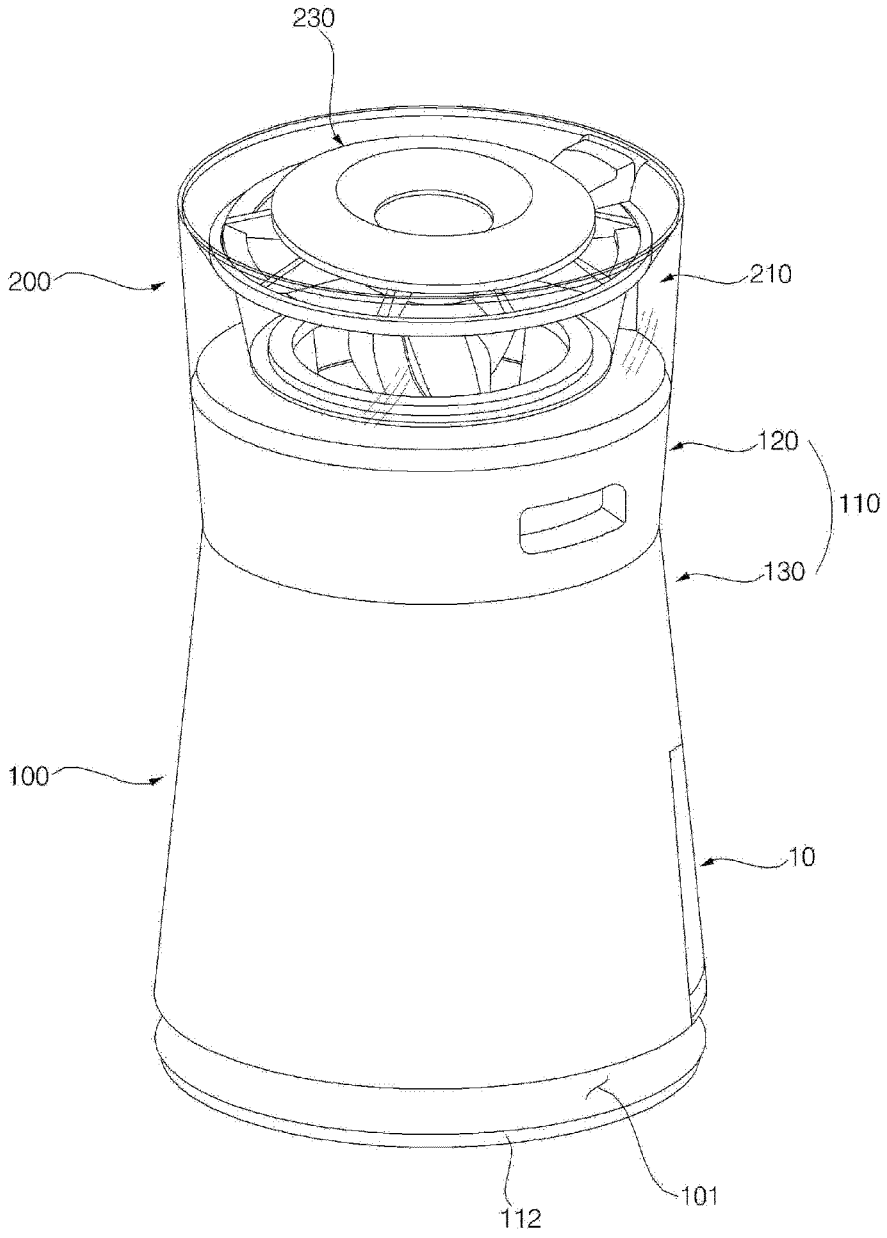
FIG. 1 is a perspective view illustrating an air conditioner according to an embodiment of the present invention.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

Hereinafter, air conditioners according to exemplary embodiments of the present invention will be described in detail with reference to the accompanying drawings.

Figure 2:
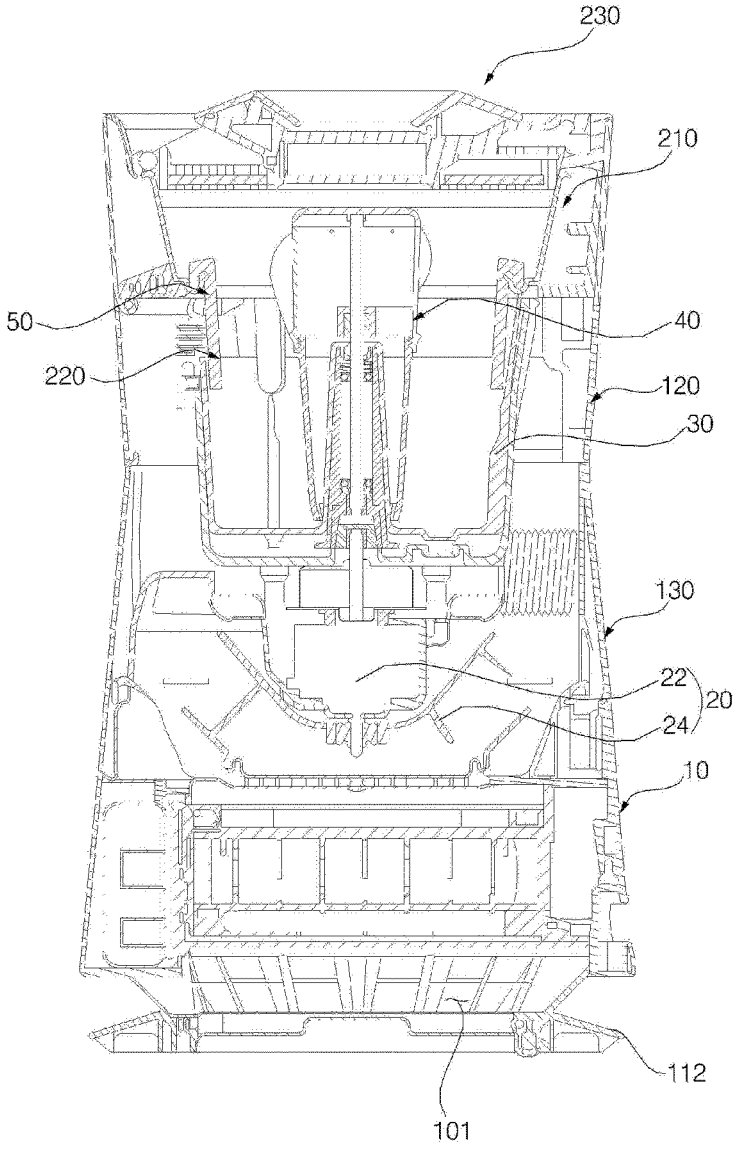
FIG. 2 is a cross-sectional view illustrating the air conditioner shown in FIG. 1.

FIG. 1 is a perspective view illustrating an air conditioner according to an embodiment of the present invention. FIG. 2 is a cross-sectional view illustrating the air conditioner shown in FIG. 1.

An air conditioner according to an embodiment of the present invention may include a cleaning module 100 receiving external air and then cleaning air, and a humidification module 200 providing moisture to air cleaned in the cleaning module 100.

The cleaning module 100 may include a base body 110 that guides external air to the humidification module 200, a filter assembly 10 that is disposed separably from the base body 110 and cleans air, and an air blowing unit 20 that is disposed inside the base body 110 to allow air to flow.

The air blowing unit 20 may include a blower fan 24 allowing air to flow and a blower motor 22 rotating the blower fan 24. In this embodiment, the blower fan 24 may be disposed under the blower motor 22. A detailed description of the blower fan 24 will be made later with reference to FIGS. 7 to 9.

In this embodiment, upward and downward directions may mean a gravity direction, and a vertical direction and a longitudinal direction may mean a direction parallel to the gravity direction. Also, the upward and downward directions, the vertical direction, and the longitudinal direction may mean a rotation axis direction of the blower motor 22 and the blower fan 24. A horizontal direction and a lateral direction may mean a direction orthogonal to the gravity direction.

The humidification module 200 may include a visual body 210, a water tank 30, a watering unit 40, a humidification medium 50, a humidification medium housing 220, and a top cover assembly 230. The visual body 210 may be separably stacked on the cleaning module 100, and may be formed of a material through which a user can see the inside. The water tank 30 may be coupled to the visual body 210, and may store water. The watering unit 40 may draw water of the water tank 30, and may pump water upward to spray pumped water. The humidification medium 50 may be wetted with water sprayed from the watering unit 40, and may humidify air passing therethrough. The humidification medium housing 220 may be equipped with the humidification medium 50. The top cover assembly 230 may be separably coupled to the visual body 210.

The base body 110 may include a lower body 130 defining the exterior, a support body 120 defining the exterior, coupled to the upper side of the lower body 130, and allowing the humidification module 200 to be separably placed thereon, a base 112 including an intake flow passage 101 for receiving external air and disposed on the bottom surface to support the base body 110. The intake flow passage 101 may be formed in the base 112 to receive external air and guide received air to the filter assembly 10.

Figure 3:
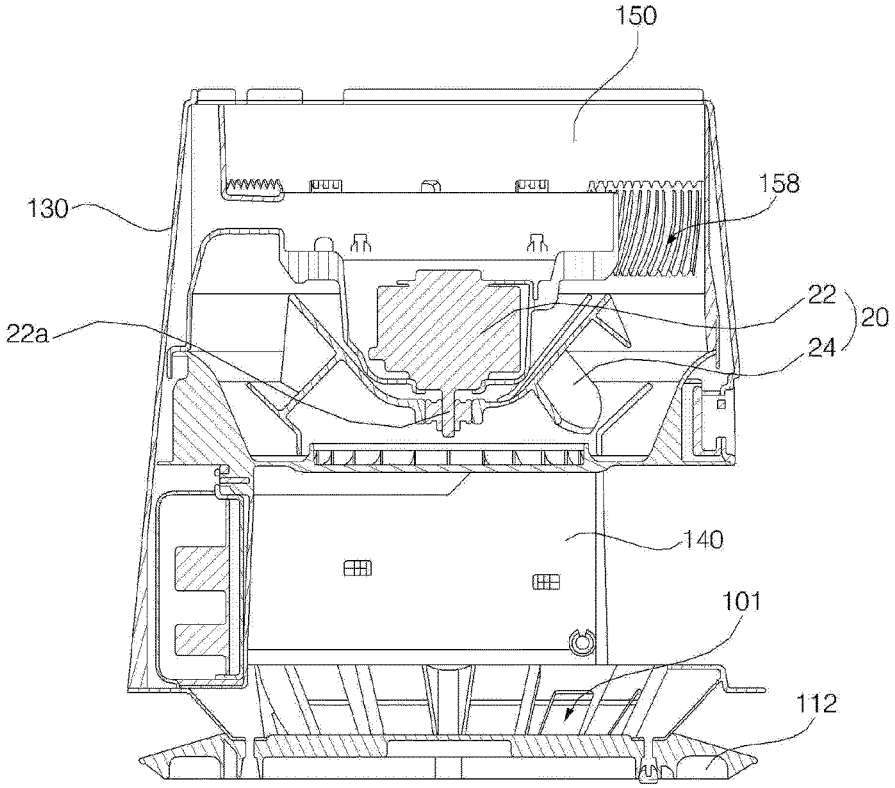
FIG. 3 is a cross-sectional view illustrating a portion of an air conditioner according to an embodiment of the present invention.
Figure 4:
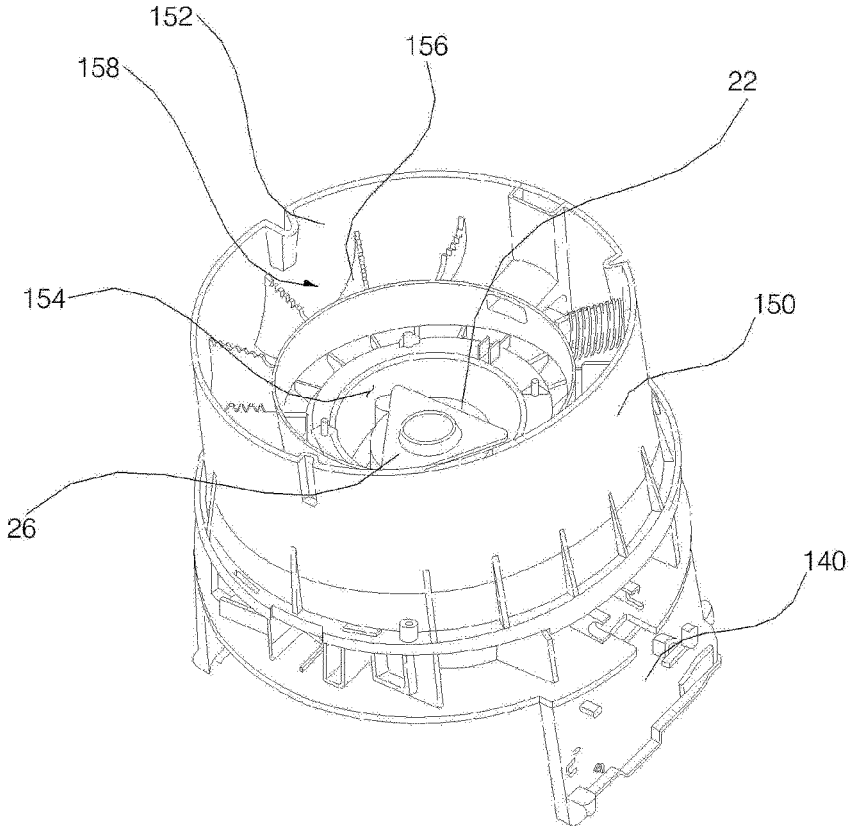
FIGS. 4 and 5 are perspective views illustrating a portion of the air conditioner shown in FIG. 3.
Figure 5:
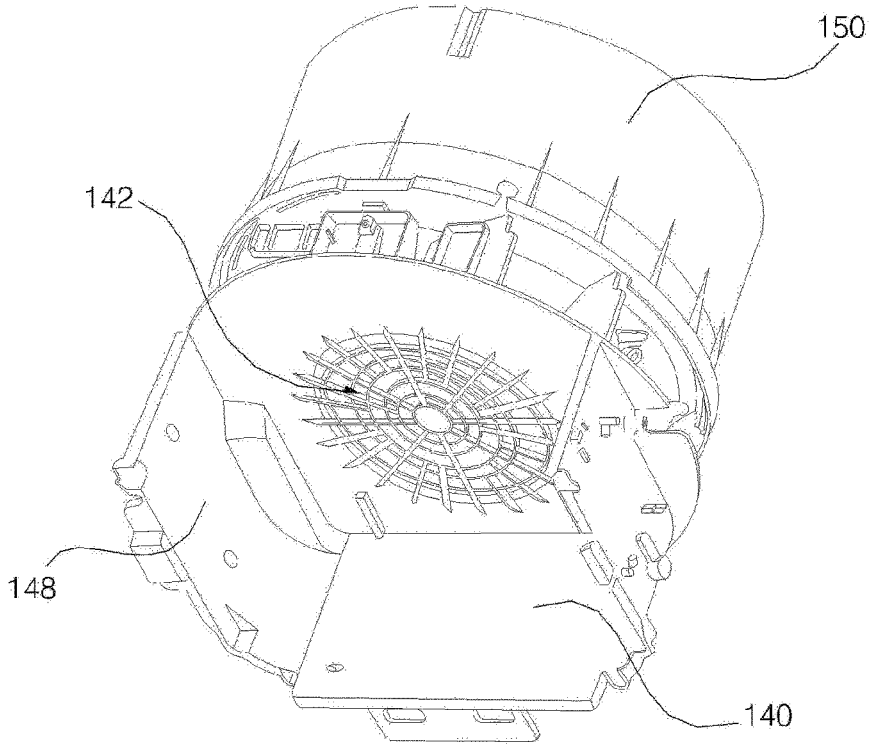
Figure 6:
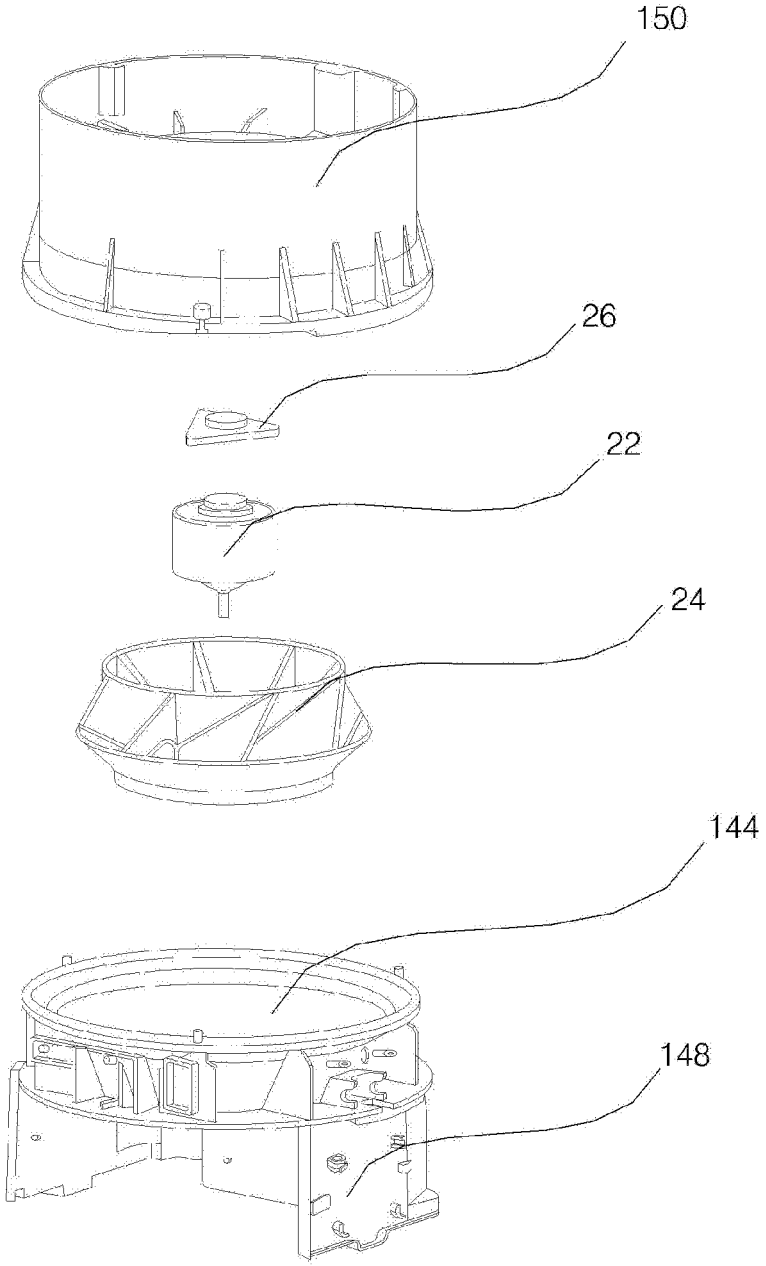
FIG. 6 is an exploded perspective view illustrating a portion of the air conditioner shown in FIG. 3.

FIG. 3 is a cross-sectional view illustrating a portion of an air conditioner according to an embodiment of the present invention. FIGS. 4 and 5 are perspective views illustrating a portion of the air conditioner shown in FIG. 3. FIG. 6 is an exploded perspective view illustrating a portion of the air conditioner shown in FIG. 3.

The air conditioner according to an embodiment of the present invention may include a blower housing 150 and a filter housing 140. The blower housing 150 may be coupled with the blower motor 22, and may include a ring-shaped air blowing flow passage 158 in which air discharged from the blower fan 24 flows. The filter housing 140 may be coupled to the blower housing 150, and may receive a lower portion of the blower fan 24.

The filter housing 140 may be disposed inside the lower body 130. The filter housing 140 may be coupled to the upper side of the base 112. The filter housing 140 may be coupled to the lower side of the blower housing 150. The filter housing 140 may be equipped with the filter assembly 10, and may guide air passing the filter assembly 10 to the blower fan 24.

The filter housing 140 may include a filter mounting part 148 disposed at a lower portion thereof and detachably mounted with the filter assembly 10, and a flow guide 146 disposed at an upper portion thereof and receiving a lower portion of the blower fan 24 of the air blowing unit 20. The filter housing 140 may include a circular inlet 142 which is formed between the filter mounting part 148 and the flow guide 146 and through which air purified through the filter assembly 10 flows into the blower fan 24. The filter housing 140 may include a radial grille formed on the inlet 142.

Figure 11:
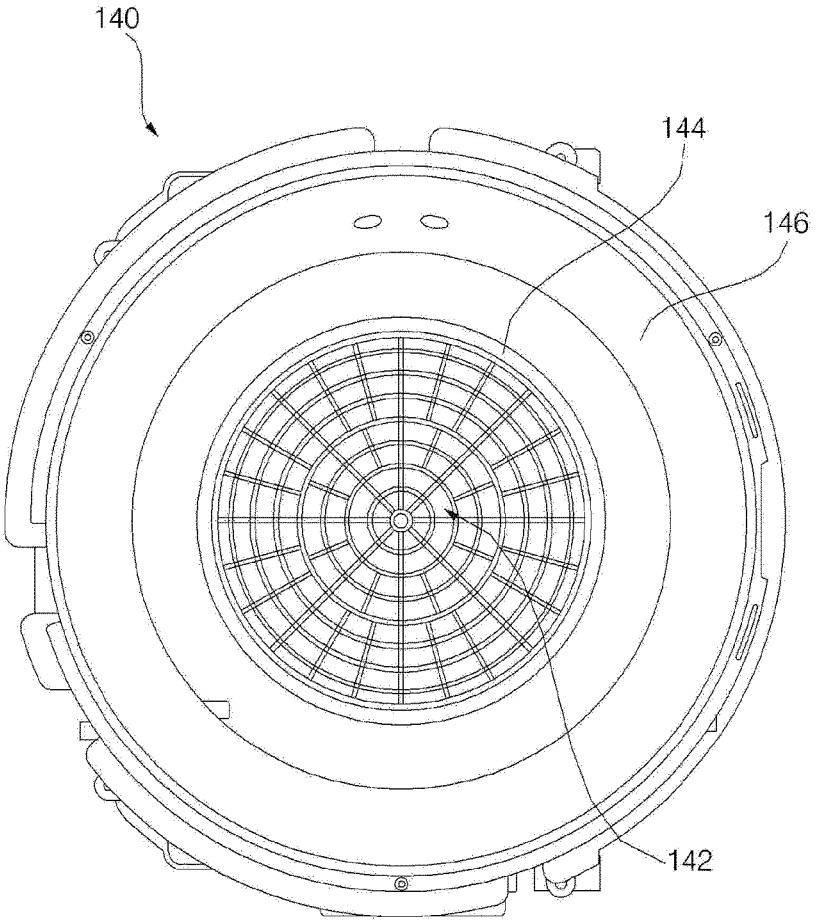
FIG. 11 is a plan view illustrating the filter housing shown in FIG. 10.
Figure 12:
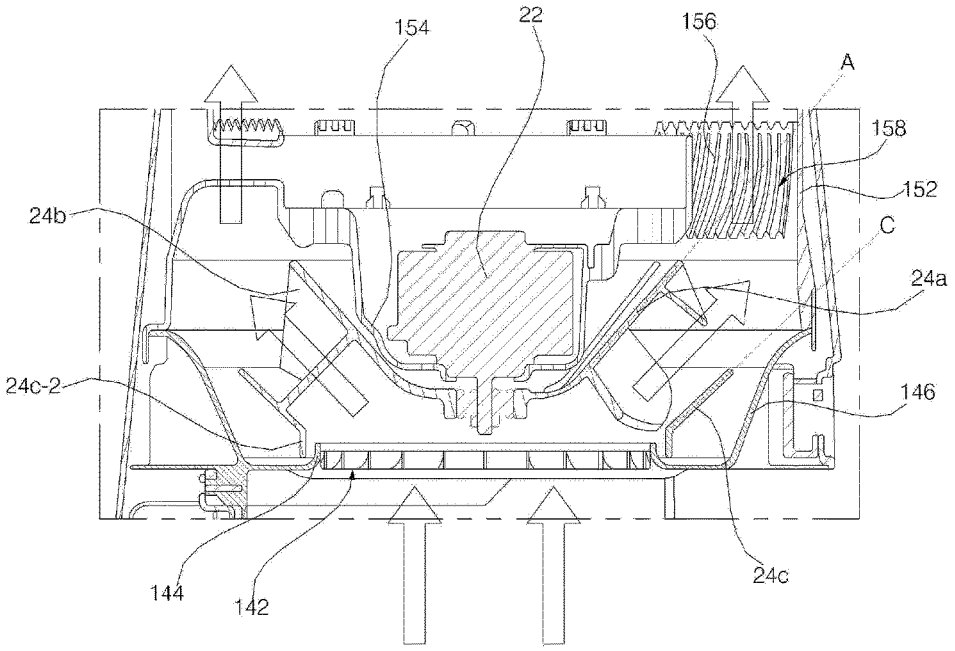
FIG. 12 is a partial cross-sectional view illustrating an air conditioner according to an exemplary embodiment of the present invention.

A detailed description of the filter housing 140 will be made later with reference to FIGS. 10 to 12.

The blower housing 150 may be disposed inside the lower body 130. The blower housing 150 may be coupled to the upper side of the filter housing 140. The blower housing 150 may be coupled to the lower side of the support body 120. The blower housing 150 may support the blower motor 22, and may guide air, discharged from the blower fan 24, to the support body 120.

The blower housing 150 may include a blower body 152 forming the exterior and having a cylindrical shape, and a motor cover 154 disposed at a central portion of the blower body 152 and having a bowl shape to receive the blower motor 22. The blower housing may include a ring-shaped air blowing flow passage 158 which is formed between the blower body 152 and the motor cover 154 and in which air discharged from the blower fan 24 flows. The blower housing 150 may include a plurality of vanes 156 disposed spaced from each other in a circumferential direction on the air blowing flow passage 158.

A detailed description of the blower housing 150 will be made later with reference to FIGS. 13 to 17.

The air blowing unit 20 may include a motor coupling part 26 disposed over the blower motor 22 and coupled to the motor cover 154 to couple the blower motor 22 to the motor cover 154.

The blower motor 22 may generate a torque to rotate the blower fan 24. The blower motor 22 may be disposed inside the motor cover 154 of the blower housing 150. The blower motor 22 may be coupled to the motor cover 154 of the blower housing 150 by the motor coupling part 26. The blower motor 22 may include a shaft 22*a* rotated by a torque. The shaft 22*a* of the blower motor 22 may penetrate a lower center of the motor cover 154 to be coupled to the blower fan 24.

The blower fan 24 may be rotated by the blower motor 22 to blow air. The blower fan 24 may blow air introduced through the inlet 142 of the filter housing 140 to discharge air to the air blowing flow passage 158. In this embodiment, the blower fan 24 may rotate clockwise when viewed from top.

In this embodiment, the blower fan 24 may be a centrifugal fan that admits air in a rotation axis direction and discharges air in radial direction. In a centrifugal fan, the air volume may be maximized at the same rotation speed and size as other kinds of fans, and air can be discharged through the ring-shaped air blowing flow passage 158. In this embodiment, the blower fan 24 may be a modified centrifugal fan in which air is obliquely discharged in an upward direction.

The blower fan 24 may be disposed under the blower motor 22. An upper portion of the blower fan 24 may be disposed outside the motor cover 154 of the blower housing 150. That is, a lower portion of the motor cover 154 may be inserted into an upper portion of the blower fan 24. A lower portion of the blower fan 24 may be inserted into the flow guide 146 of the filter housing 140. A lower end of the blower fan 24 may be disposed adjacent to the inlet 142 of the filter housing 140. The shaft 22*a* of the blower motor 22 may be coupled to the center of the blower fan 24.

Figure 7:
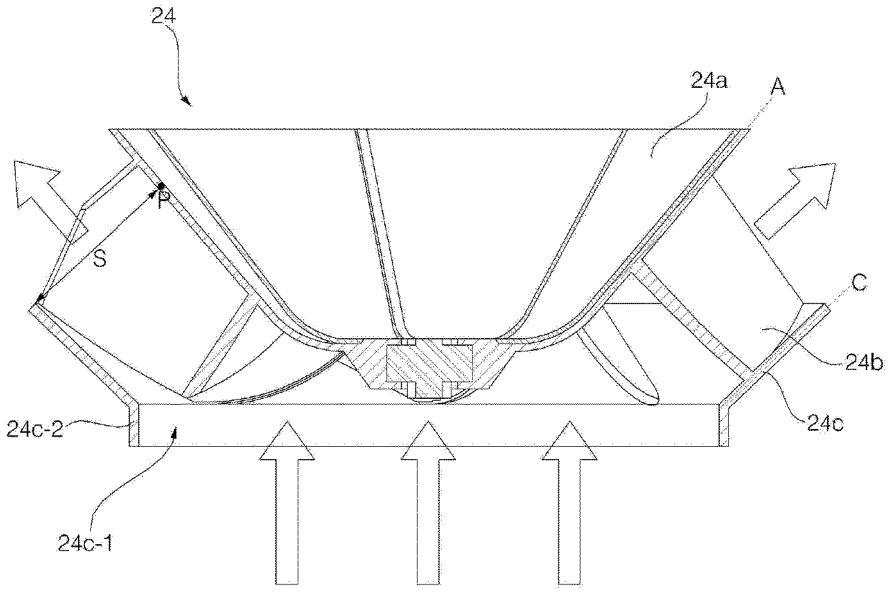
FIG. 7 is a cross-sectional view illustrating a blower fan of an air conditioner according to an embodiment of the present invention.
Figure 8:
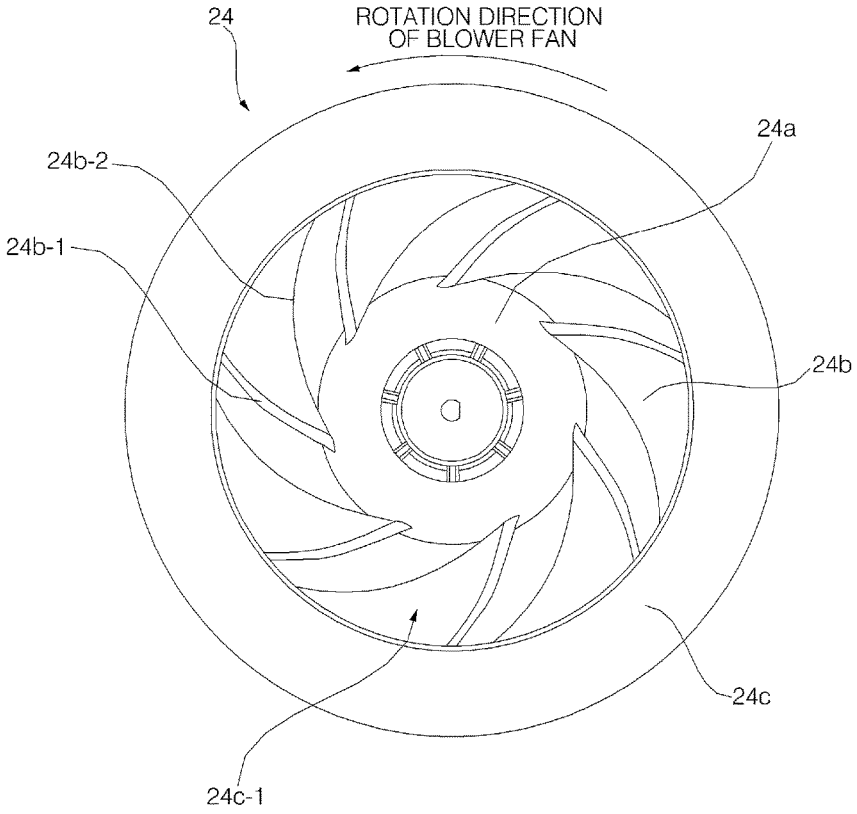
FIG. 8 is a bottom view illustrating the blower fan shown in FIG. 7.
Figure 9:
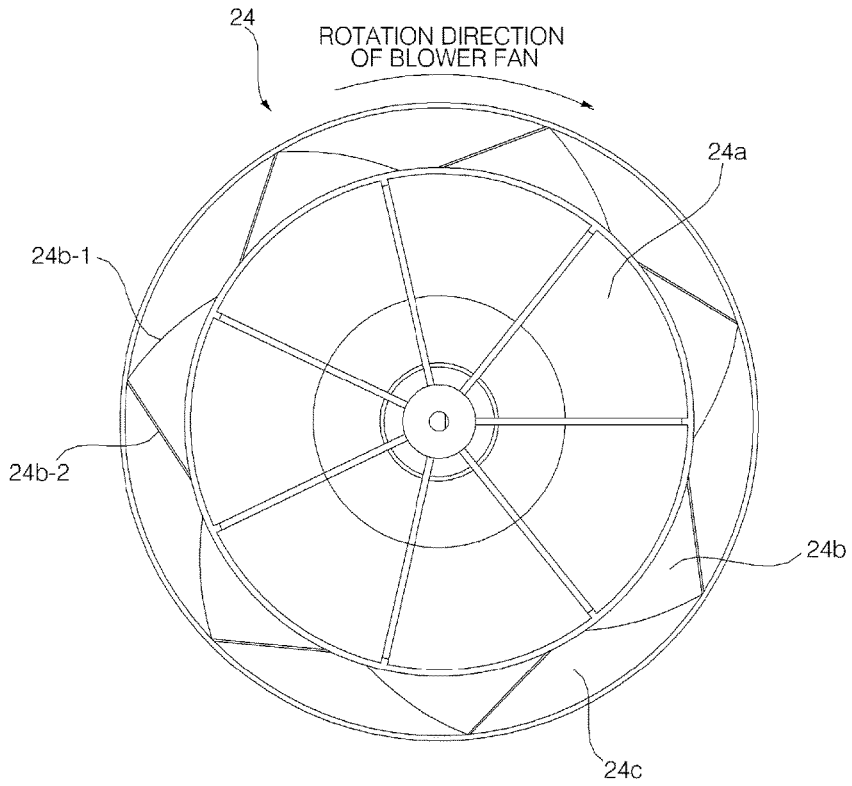
FIG. 9 is a plan view illustrating the blower fan shown in FIG. 7.

FIG. 7 is a cross-sectional view illustrating a blower fan of an air conditioner according to an embodiment of the present invention. FIG. 8 is a bottom view illustrating the blower fan shown in FIG. 7. FIG. 9 is a plan view illustrating the blower fan shown in FIG. 7.

The blower fan 24 may include a hub 24*a* having a center thereof coupled with the shaft 22*a* of the blower motor 22, a shroud 24*c* spaced from the hub 24*a* and including an inlet hole 24*c*-1 formed at a central portion thereof to receive air, and a plurality of blades 24*b* disposed between the hub 24*a* and the shroud 24*c*.

The blade 24*b* may be provided in plurality between the hub 24*a* and the shroud 24*c*. The upper end of the blade 24*b* may be coupled to the bottom surface of the hub 24*a*, and the lower end of the blade 24*b* may be coupled to the top surface of the shroud 24*c*. The plurality of blades 24*b* may be disposed spaced in a circumferential direction. The section of the blade 24*b* may be a form of airfoil.

The side end of the blade 24*b* which air flows into may be referred to as a leading edge 24*b*-1, and the side end of the blade 24*b* which air flows out of may be referred to as a trailing edge 24*b*-2.

The blade 24*b* may be obliquely formed with respect to a vertical direction such that discharged air obliquely directs to an upper side in a radial direction. In this embodiment, the trailing edge 24*b*-2 of the blade 24*b* may be obliquely formed in a right direction at an upper side when viewed from a side of the blower fan 24 in a rotation axis direction. The leading edge 24*b*-1 of the blade 24*b* may be shorter than the trailing edge 24-2 such that discharged air obliquely directs to an upper side in a radial direction.

The hub 24*a* may have a cone shape that increasingly protrudes downward to the center thereof. A lower portion of the motor cover 154 may be inserted into an upper portion of the hub 24*a*, and thus at least a portion of the blower motor 22 may be disposed inside the hub 24*a*. Due to this structure, the height that blower motor 22 and the blower fan 24 occupy can be minimized, and thus the whole height of the air conditioner can be minimized.

The shaft 22*a* of the blower motor 22 that is disposed over the hub 24*a* may be coupled to the center of the hub 24*a*. The hub 24*a* may be disposed over the shroud 24*c*, and may be spaced from the shroud 24*c*. The plurality of blades 24*b* may be coupled to the undersurface of the hub 24*a*.

The hub 24*a* may have an outer circumferential end thereof formed to incline in a direction opposite to the direction of the inlet hole 24*c*-1. The outer circumferential end of the hub 24*a* may mean the circumference of the upper end of the hub 24*a*. The direction to which the outer circumferential end of the hub 24*a* directs may form about 45 degrees with a horizontal direction. The outer circumferential end of the hub 24*a* may be obliquely formed in an upward direction such that air is obliquely discharged upward.

The longitudinal section of the hub 24*a* may be formed into a form of straight line A which is oblique from the central portion to the outer circumferential end of the hub 24*a* in a direction opposite to the direction of the inlet hole 24*c*-1. The longitudinal section of the hub 24*a* may be formed into a straight line A which is oblique from a portion of the hub 24*a*, connected to each leading edge 24*b*-1 of the plurality of blades 24*b*, to the outer circumferential end of the hub 24*a*. The hub 24*a* may have a diameter which uniformly increases from the center portion to the outer circumferential end thereof. The hub 24*a* may be formed to have a diameter that uniformly increases from a portion of the hub 24*a*, connected to each leading edge 24*b*-1 of the plurality of blades 24*b*, to the outer circumferential end of the hub 24*a*.

The shroud 24*c* may have a bowl shape, and may have the circular inlet hole 24*c*-1 formed at the central portion thereof to receive air. The inlet hole 24*c*-1 of the shroud 24*c* may be disposed to correspond to the inlet 142 of the filter housing 140. That is, the inlet 142 of the filter housing 140 may be formed at a portion corresponding to the inlet hole 24*c*-1 of the shroud 24*c*. The diameter of the inlet hole 24*c*-1 may be larger than the diameter of the inlet 142 of the filter housing 140. The shroud 24*c* may include an intake guide 24*c*-2 that is formed at the circumferential portion of the inlet hole 24*c*-1 and vertically protrudes downward.

The shroud 24*c* may be disposed under the hub 24*a*, and may be spaced from the hub 24*a*. The plurality of blades 24*b* may be coupled to the top surface of the shroud 24*c*.

The shroud 24*c* may have an outer circumferential end thereof formed to incline in a direction opposite to the direction of the inlet hole 24*c*-1. The outer circumferential end of the shroud 24*c* may mean the circumference of the upper end of the shroud 24*c*. The direction to which the outer circumferential end of the shroud 24*c* directs may form about 45 degrees with a horizontal direction. The outer circumferential end of the shroud 24*c* may be obliquely formed in an upward direction such that air is obliquely discharged upward. The direction to which the outer circumferential end of the shroud 24*c* directs may be substantially parallel to the direction to which the outer circumferential end of the hub 24*a* directs.

The longitudinal section of the shroud 24*c* may be formed into a form of straight line C which is oblique from the upper end of the intake guide 24*c*-2 to the outer circumferential end of the shroud 24*c* in a direction opposite to the direction of the inlet hole 24*c*-1. The longitudinal section of the shroud 24*c* may be formed into a straight line C which is oblique from a portion of the shroud 24*c*, connected to each leading edge 24*b*-1 of the plurality of blades 24*b*, to the outer circumferential end of the shroud 24*c*. The shroud 24*c* may have a diameter which uniformly increases from the upper end of the intake guide 24*c*-2 to the outer circumferential end thereof. The shroud 24*c* may be formed to have a diameter that uniformly increases from a portion of the shroud 24*c*, connected to each leading edge 24*b*-1 of the plurality of blades 24*b*, to the outer circumferential end of the shroud 24*c*.

The oblique straight line C of the longitudinal section of the shroud 24*c* and the oblique straight line A of the longitudinal section of the hub 24*a* may be substantially parallel to each other. According to embodiment, an interval between the shroud 24*c* and the hub 24*a* may gradually increases to the outer circumferential end thereof.

The diameter of the outer circumferential end of the shroud 24*c* may be larger than the diameter of the outer circumferential end of the hub 24*a*. The outer circumferential end of the shroud 24*c* may further protrude in a radial direction than the outer circumferential end of the hub 24*a*. The outer circumferential end of the hub 24*a* may further protrude in a radial direction than a point P where a line S forming the shortest distance from the outer circumferential end of the shroud 24*c* to the hub 24*a* meets the hub 24*a*.

Figure 10:
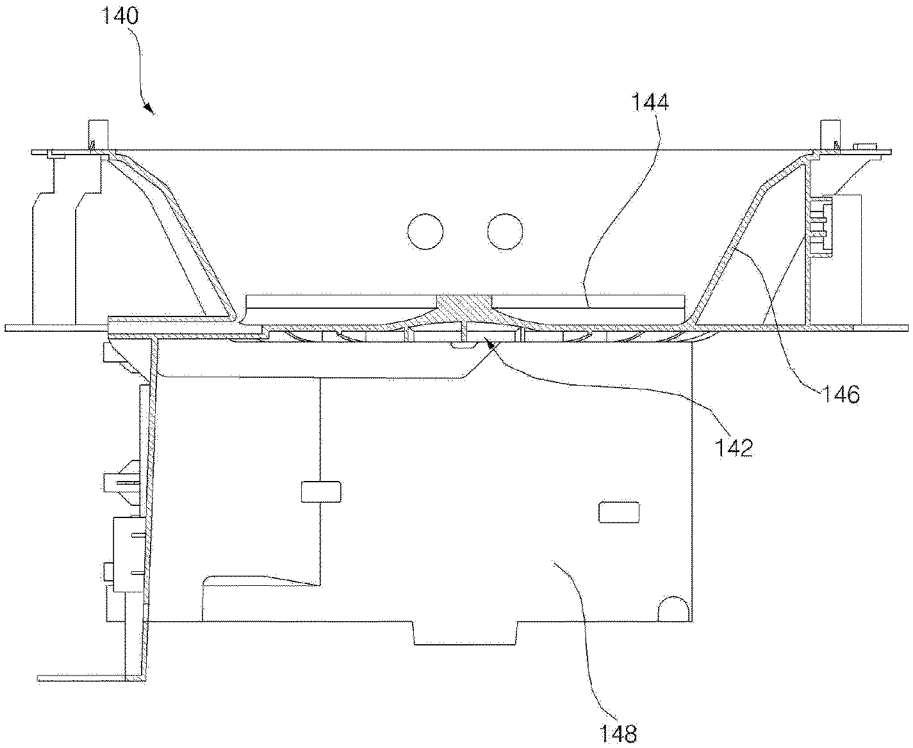
FIG. 10 is a cross-sectional view illustrating a filter housing of an air conditioner according to an embodiment of the present invention.

FIG. 10 is a cross-sectional view illustrating a filter housing of an air conditioner according to an embodiment of the present invention. FIG. 11 is a plan view illustrating the filter housing shown in FIG. 10. FIG. 12 is a partial cross-sectional view illustrating an air conditioner according to an exemplary embodiment of the present invention.

The filter mounting part 148 may form a lower portion of the filter housing 140, and may receive the filter assembly 10. The base 112 may be coupled to a lower side of the filter mounting part 148. A circular inlet 142 into which air flows may be formed in the upper surface of the filter mounting part 148.

The filter housing 140 may include an inflow guide 144 having a rim shape and upwardly protruding from a circumferential portion of the inlet hole 24*c*-1. The inflow guide 144 may protrude to the inside of the intake guide 24*c*-2 of the shroud 24*c*. The diameter of the inflow guide 144 may be formed to be smaller than the diameter of the intake guide 24*c*-2 such that the upper end of the inflow guide 144 is inserted into the intake guide 24*c*-2. The inflow guide 144 may be disposed concentrically with the intake guide 24*c*-2.

The flow guide 146 may form an upper portion of the filter housing 140, and may accommodate a lower portion of the blower fan 24. The flow guide 146 may include a least a portion of an inner surface thereof corresponding to the shroud 24*c*, which is obliquely formed. The flow guide 146 may prevent air discharged out of the blower fan 24 from flowing into a lower side of the shroud 24*c*. The flow guide 146 may have a gradually increasing inner diameter toward an outer circumferential end thereof. The outer circumferential end of the flow guide 146 may mean the circumference of the upper end of the flow guide 146.

The distance between the inner surface of the flow guide 146 and the shroud 24*c* may gradually become closer toward the outer circumferential end thereof.

The outer circumferential end of the flow guide 146 may be formed higher than the outer circumferential end of the shroud 24*c*. However, the outer circumferential end of the flow guide 146 may be formed lower than the line C straightly extending from the outer circumferential end of the shroud 24*c*. The flow guide 146 may be formed such that the line C straightly extending from the outer circumferential end of the shroud 24*c* does not meet the flow guide 146. That is, the flow guide 146 may be formed such that air guide by the shroud 24*c* does not directly meet the flow guide 146. The line C straightly extending from the outer circumferential end of the shroud 24*c* may direct to the air blowing flow passage 158, and may meet the inner surface of the blower body 152 of the blower housing 150.

The blower housing 150 may be formed such that the line A straightly extending from the outer circumferential end of the hub 24*a* may direct to the air blowing flow passage 158 and meets the vane 156. The motor cover 154 of the blower housing 150 may be formed so as not to meet the line A straightly extending from the outer circumferential end of the hub 24*a*. At least a portion of the outer surface of the motor cover 154 of the blower housing 150 may be formed obliquely along the hub 24*a*. At least a portion of the outer surface of the motor cover 154 may be formed closely to the hub 24*a* to prevent air discharged out of the blower fan 24 from flowing into an upper central portion of the hub 24*a*.

Figure 13:
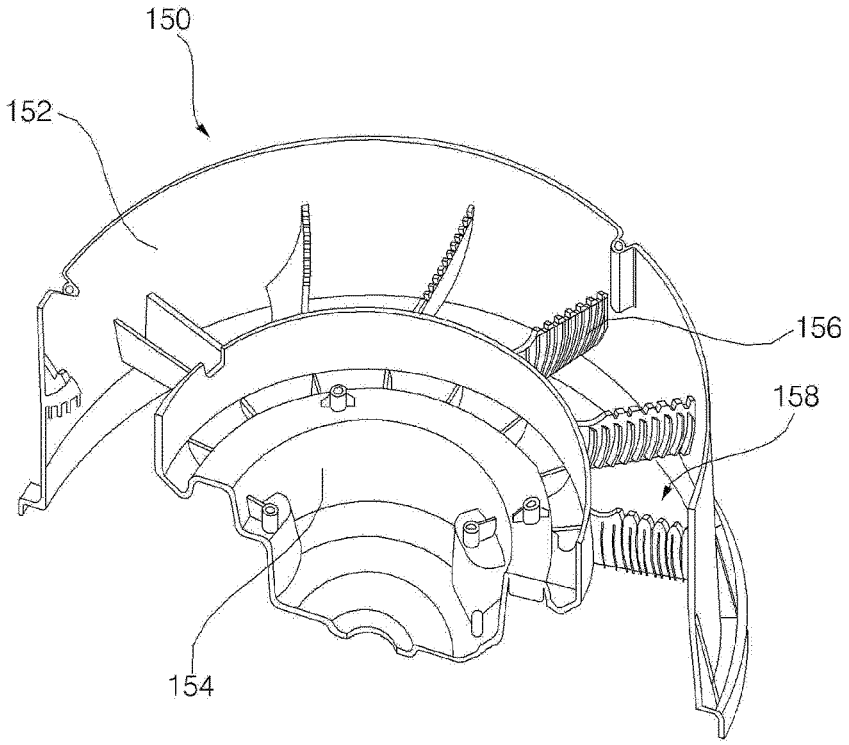
FIG. 13 is a perspective cross-sectional view illustrating a blower housing of an air conditioner according to an embodiment of the present invention.
Figure 14:
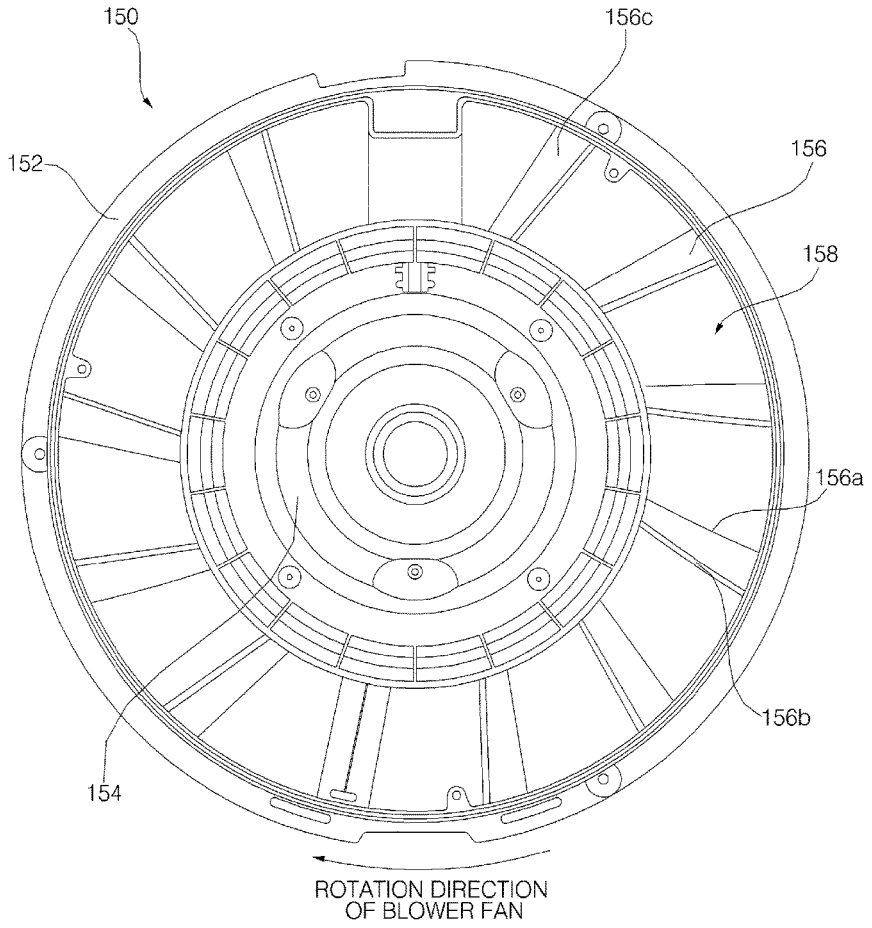
FIG. 14 is a plan view illustrating the blower housing shown in FIG. 13.
Figure 15:
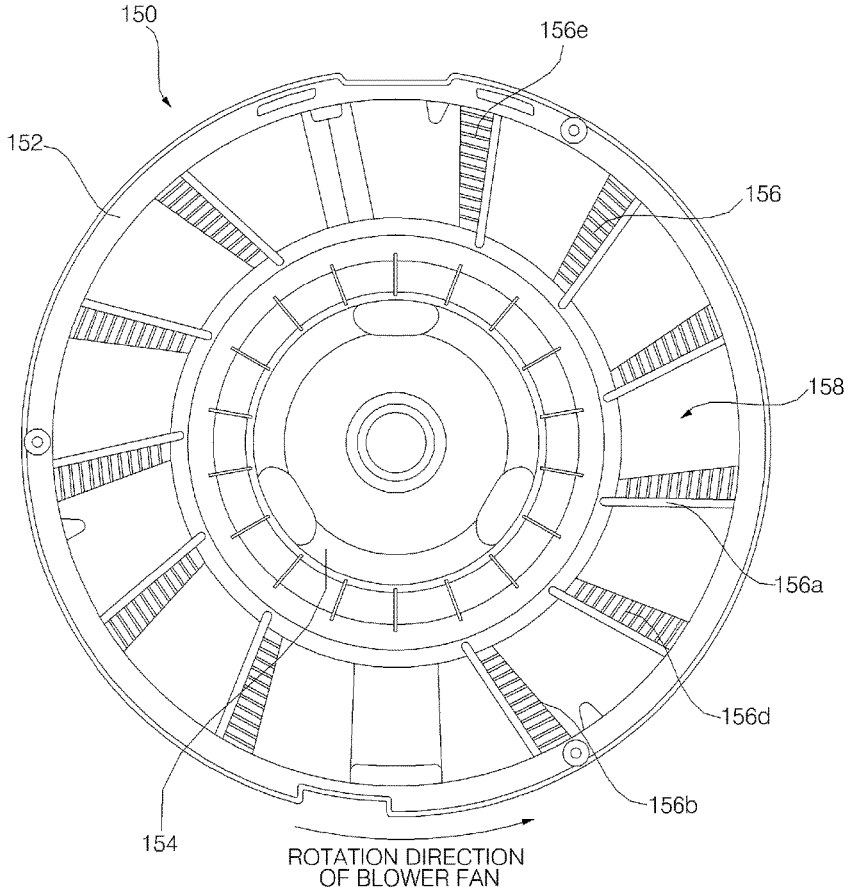
FIG. 15 is a bottom view illustrating the blower housing shown in FIG. 13.
Figure 16:
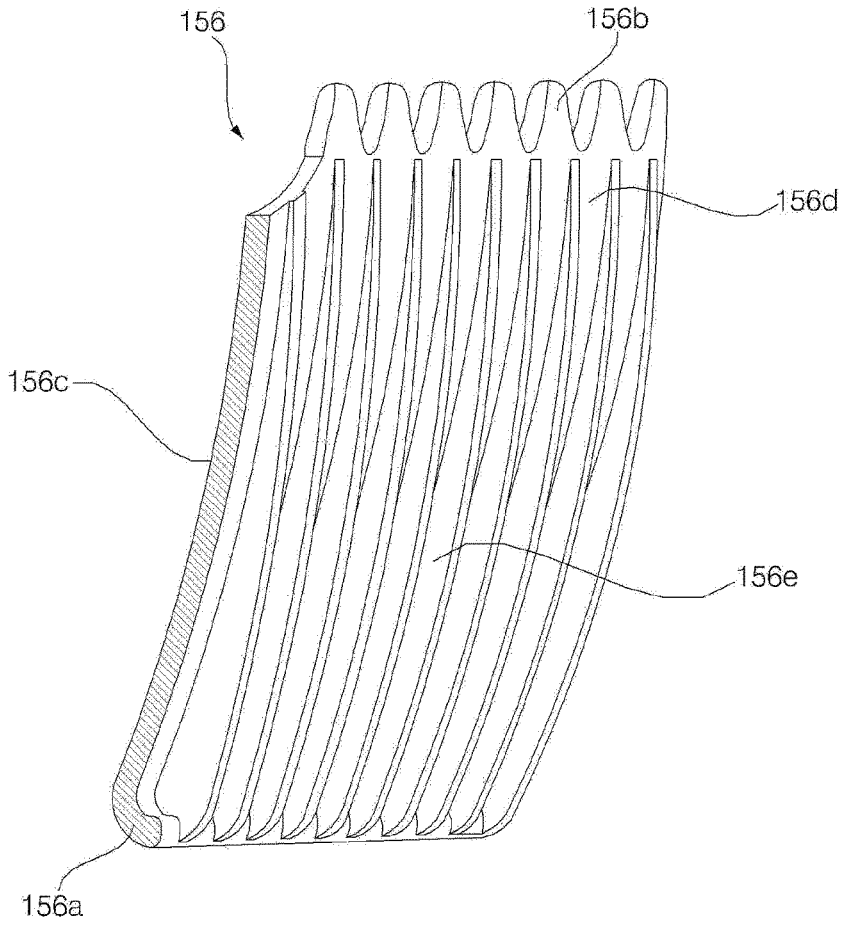
FIG. 16 is a perspective view illustrating a vane of the blower housing shown in FIG. 13.
Figure 17:
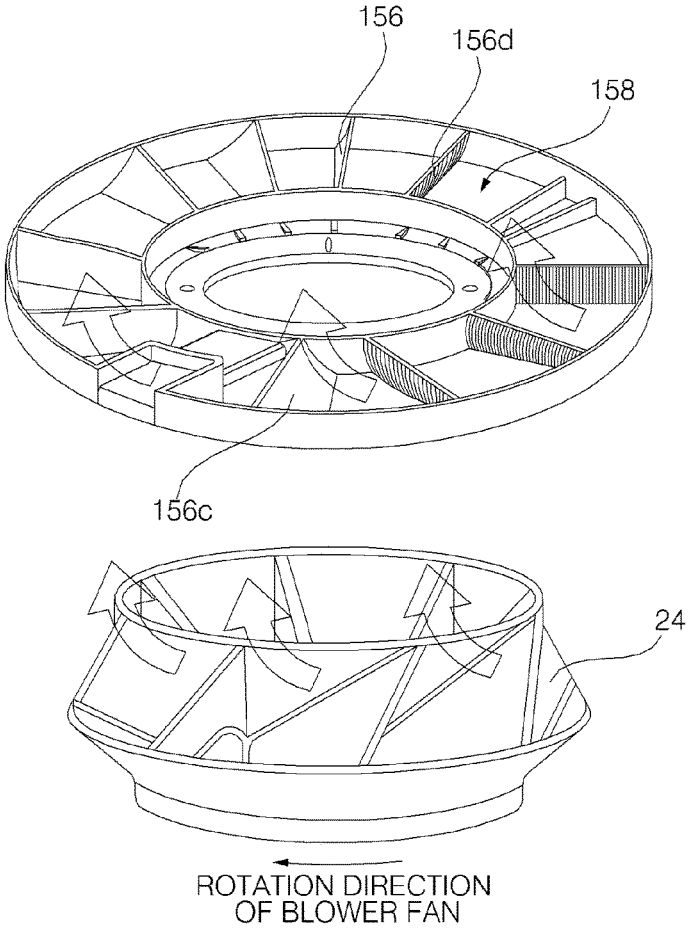
FIG. 17 is a view illustrating an operation of the vane shown in FIG. 16.

FIG. 13 is a perspective cross-sectional view illustrating a blower housing of an air conditioner according to an embodiment of the present invention. FIG. 14 is a plan view illustrating the blower housing shown in FIG. 13. FIG. 15 is a bottom view illustrating the blower housing shown in FIG. 13. FIG. 16 is a perspective view illustrating a vane of the blower housing shown in FIG. 13. FIG. 17 is a view illustrating an operation of the vane shown in FIG. 16.

The blower body 152 may have a cylindrical shape, and a plurality of vanes 156 may be coupled to an inner circumferential surface of the blower body 152. The blower body 152 may form the ring-shape air blowing flow passage 158 together with the motor cover 154. The flow guide 146 may be coupled to the lower side of the blower body 152. The circumference of the lower end of the blower body 152 may be larger than the outer circumferential end of the flow guide 146 such that the lower end of the blower body 152 covers and is coupled to the upper end of the flow guide 146. The support body 120 may be coupled to an upper side of the blower body 152.

The motor cover 154 may have a bowl shape, and the blower motor 22 may be inserted into and coupled to the motor cover 154. The plurality of vanes 156 may be coupled to the outer circumferential surface of the motor cover 154. The blower motor 22 may be disposed inside the motor cover 154, and an upper portion of the blower fan 24 may be disposed outside the motor cover 154. The motor cover 154 may be disposed at a central portion of the blower body 152 while being spaced from the motor cover 154, and may form the ring-shaped air blowing flow passage 158 together with the blower body 152.

The plurality of vanes 156 may be disposed on the air blowing flow passage 158 while being spaced. The plurality of vanes 156 may connect the motor cover 154 and the blower body 152, and may support the motor cover 154 and the blower body 152 such that the motor cover 154 is spaced from the blower body 152.

The plurality of vanes 156 may upwardly guide air discharged from the blower fan 24 to the air blowing flow passage 158. Each of the plurality of vanes 156 may be formed into a bent plate shape which is uprightly disposed almost in a vertical direction. Each of the plurality of vanes 156 may include a plurality of ribs 156*e* formed on one surface thereof in an air flow direction.

The surface of the vane 156 to which air flows may be referred to as a positive pressure surface 156*c*, and the opposite surface to the positive pressure surface 156*c* may be referred to as a negative pressure surface 156*d*. In this embodiment, the surface on which the plurality of ribs 156*e* are not formed may be a positive pressure surface, and the surface on which the plurality of ribs 156*e* are formed may be a negative pressure surface. In regard to the vane 156, the lower end that is an upstream side of the air flow direction may be referred to as a front end 156*a*, and the upper end that is a downstream side of the air flow direction may be referred to as a rear end 156*b*.

Air discharged from the blower fan 24 may be obliquely discharged upward to the air blowing flow passage 158 in a circumferential direction, and may rotate in a rotation direction of the blower fan 24 when entering the air blowing flow passage 158. In this embodiment, air discharged from the blower fan 24 may rotate clockwise when viewed from top, and may flow upward.

In each of the plurality of vanes 156, the positive pressure surface 156*c* may be concavely formed, and the negative pressure surface 156*d* may be convexly formed. In each of the plurality of vanes 156, the rear end 156*b* that is a surface coupled to the blower body 152 may be formed to direct to the upper side, and toward the front end 165, the vane 156 may be bent in a direction (direction of the positive pressure surface 156*c* on which the ribs are not formed) from which air flows. In each of the plurality of vanes 156, the front end 156 may direct to the rotation direction of the blower fan 24 in a radial direction, and the rear end 156*b* may direct to the rotation direction of the blower fan 24 in a radial direction. Each of the plurality of vanes 156 may guide air spirally swirling due to the above-mentioned shape, so as to allow air to flow in a vertical direction.

The plurality of ribs 156*e* may protrude from the negative pressure surface 156*d* of the vane 156, and the longitudinal direction of the rib 156*e* may be formed to become the air flow direction. Each of the plurality of ribs 156*e* may be formed in a form of airfoil in which the height of the section thereof gradually decreases from the front end to the rear end. Each of the plurality of ribs 156*e* may be convexly formed in a bent direction of the negative pressure surface 156*d* of the vane 156. The plurality of ribs 156*e* may be formed on the negative pressure surface 156*d* of the vane 156 to prevent a swirl from occurring on the negative pressure surface 156*d* of the vane 156 and allow air to flow in an upward direction.

Each of the plurality of vanes 156 may be formed such that the front end 156*a* is curvedly bent from the positive pressure surface 156*c* to the negative pressure surface 156*d*. The front end 156*a* of each of the plurality of vanes 156 may be curvedly bent in a height direction of the plurality of ribs 156*e*, and thus may allow air introduced in a direction of the positive pressure surface 156 to flow upward along the positive pressure surface 156*c*. Also, the front ends 156*a* of the plurality of vanes 156 may guide air, flowing to the negative pressure surface 156*d*, toward the plurality of vanes 156.

In each of the plurality of vanes 156, the rear end 156*b* may have a saw-toothed shape. The rear end 156*b* of the vane 156 may be formed into a saw-toothed shape, and thus a time difference may occur on air coming away from the rear end 156*b*, thereby inhibiting occurrence of noise.

Hereinafter, the operation of the air conditioner configured as above will be described as follows.

When a torque is generated by the blower motor 22, the blower fan 24 connected to the shaft 22*a* of the blower motor 22 may rotate. When the blower fan 24 rotates and thus air blows, external air may flow into the intake flow passage 101 of the base 112. Air introduced through the intake flow passage 101 may be purified while passing the filter assembly 10, and then may be entered into the inlet hole 24*c*-1 of the shroud 24*c* of the blower fan 24 through the inlet 142 of the filter housing 140. Air entered to the blower fan 24 may be obliquely discharged in an upward direction by the shroud 24*c* and the hub 24*a*. Air discharged out of the blower fan 24 may pass the air blowing flow passage 158 of the air blowing unit 20, and may flow in an upward direction by the plurality of vanes 156. Air passing through the air blowing flow passage 158 may be guided to the humidification module 200 placed on the support body 120. Air flowing into the humidification module 200 may be humidified while passing through the humidification medium 50, and then may be upwardly discharged through the top cover assembly 230.

Figure 18:
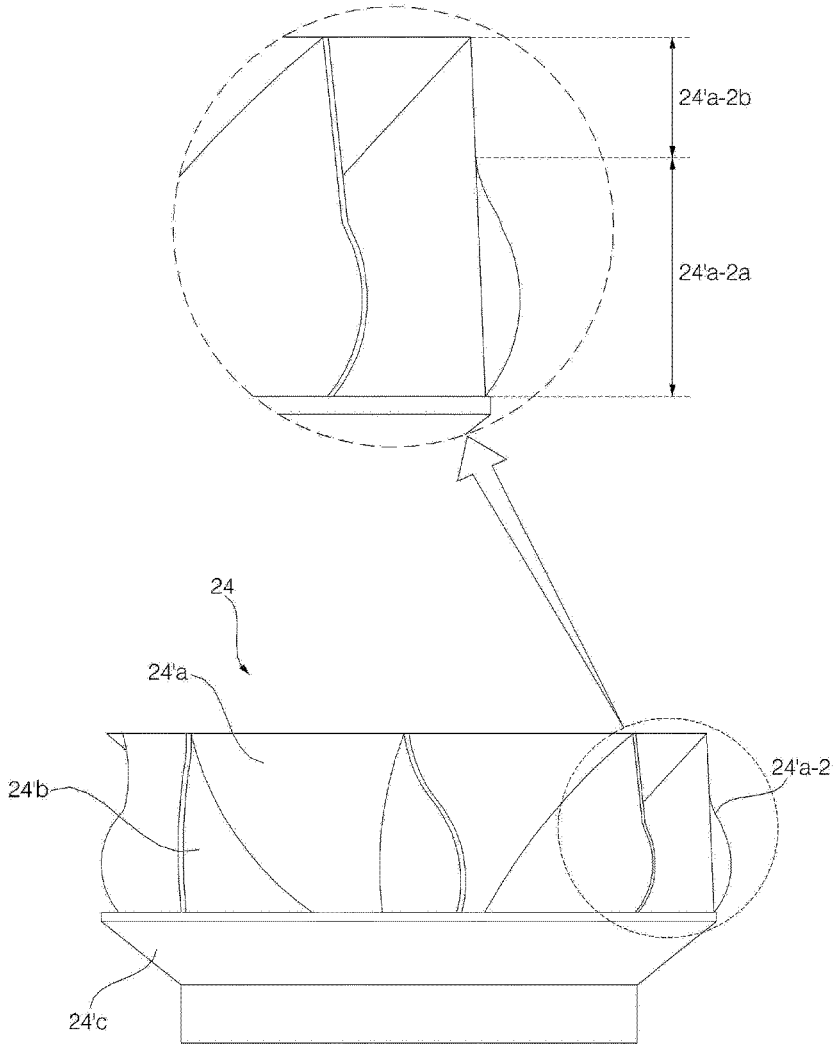
FIG. 18 is a front view illustrating a blower fan of an air conditioner according to another embodiment of the present invention.

FIG. 18 is a front view illustrating a blower fan of an air conditioner according to another embodiment of the present invention.

A blower fan 24' according to another embodiment of the present invention may include a hub 24'*a* having a center thereof coupled with the shaft, a shroud 24'*c* spaced from the hub 24'*a* and including an inlet hole formed at a central portion thereof to receive air, and a plurality of blades 24*b* disposed between the hub 24'*a* and the shroud 24'*c*.

Since the hub 24'*a* and the shroud 24'*c* of the blower fan 24' according to another embodiment of the present invention are identical to the hub 24*a* and the shroud 24*c* according to an embodiment of the present invention, a detailed description thereof will be omitted herein.

In each of blades 24'*b* according to another embodiment of the present invention, a trailing edge 24'*b*-2 of the blade 24'*b* may include at least one curve. A portion of each trailing edge 24'*b*-2 of the plurality of blades 24'*b* may further protrude in a radial direction than a virtual line L connecting between a point connected to the shroud 24'*c* and a point connected to the hub 24'*a*. The radially protruding portion of the trailing edge 24'*b*-2 may be formed into a curve. A portion of the trailing edge 24'*b*-2 close to the point connected to the shroud 24'*c* may be formed into a curve, and a portion of the trailing edge 24'*b*-2 close to the point connected to the hub 24'*a* may be formed into a straight-line.

The portion of the trailing edge 24'*b*-2 close to the point connected to the shroud 24'*c* may be formed in a curve, and may be convexly formed so as to protrude in a radial direction. Thus, occurrence of a whirl due to a flow interference of the shroud 24'*c* and the trailing edge 24'*b*-2 can be inhibited.

The portion 24'*a*-2*a* of the trailing edge 24'*b*-2 formed into a curve may be greater than the portion 24'*a*-2*b* formed into a straight-line. When the portion 24'*a*-2*a* formed into a curve is greater, occurrence of a swirl may be further inhibited. However, when the area of the blade 24*b* is excessively widened, the power consumption of the blower motor 22 may increase. Accordingly, it may be desirable that the portion 24'*a*-2*a* formed into a curve ranges from about 75% to about 85% of the trailing edge 24'*b*-2.

The blower fans, the flow guides, and the vanes according to embodiments may be applied to various air conditioners that perform purification, humidification, cooling, and heating by blowing air.

An air conditioner according to an exemplary embodiment of the present invention has at least one of the following effects.

First, a plurality of vanes disposed at a blower fan slipstream can guide air discharged from a blower fan in a spiral form in a vertical direction, and thus can maximize the air volume while reducing a flow loss, noise and vibration.

Second, a time difference occurs on air slipping away from the vane by forming sawteeth at the rear end of the vane, and thus occurrence of noise can be inhibited.

Third, occurrence of swirl can be inhibited by forming a rib on the negative pressure surface of the vane, and air is guided so as to flow upward. Thus, the flow loss and occurrence of noise and vibration can be inhibited.

Fourth, air purified at a lower side can be allowed to flow upward and then humidified, and thus cleaning and humidification of air can be smoothly performed.

The effects of the present invention are not limited to the above; other effects that are not described herein will be clearly understood by the persons skilled in the art from the following claims.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An air conditioner, comprising:

a blower fan to blow air;

a blower motor to rotate the blower fan; and a blower housing comprising a blower body forming the exterior and having a cylindrical shape and a motor cover disposed at a central portion of the blower body to form a space into the blower motor is inserted, the blower housing having a ring-shaped air blowing flow passage between an inner circumferential surface of the air blower body and an outer circumferential surface of the motor cover in which air discharged from the blower fan flows, wherein the blower fan, comprising, a hub coupled with a shaft of the blower motor and extending in a direction of the air blowing flow passage with a large radius;

a shroud spaced from the hub, extending in a direction in which the hub extends and including an inlet hole formed at a central portion thereof to receive air; and a plurality of blades disposed between the hub and the shroud, wherein the blower housing comprises a plurality of vanes disposed spaced from each other in a circumferential direction on the ring-shaped air blowing flow passage, wherein each of the plurality of vanes is formed into a bent plate shape in which a negative pressure surface thereof is convexly formed and a positive pressure surface thereof is concavely formed, wherein each of the plurality of vanes comprises a plurality of ribs formed on the negative pressure surface of the vane, wherein a height of the section of each of the plurality of ribs gradually decreases from the front end to the rear end.

2. The air conditioner of claim 1, wherein each of the plurality of vanes has a rear end that is a downstream side of an air flow direction and is formed into a saw-toothed shape.

3. The air conditioner of claim 1, wherein each of the plurality of ribs has a section thereof formed in a form of airfoil.

4. The air conditioner of claim 1, wherein each of the plurality of vanes has a front end that is an upstream side of the air flow direction and is curvedly bent to the surface on which the plurality of ribs are formed.

5. The air conditioner of claim 1, wherein the vane has a front end thereof which is an upstream side of an air flow direction and gradually further directs to a rotation direction of the blower fan in a radial direction.

6. The air conditioner of claim 1, wherein the vane has a rear end thereof which is a downstream side of an air flow direction and gradually further directs to a rotation direction of the blower fan in a radial direction.

7. The air conditioner of claim 1, further comprising a motor cover disposed at a central portion of the blower body to accommodate the blower motor, wherein the plurality of vane connects the motor cover with the blower body.

8. The air conditioner of claim 7, wherein the air blowing flow passage is formed between the blower body and the motor cover.

9. The air conditioner of claim 7, further comprising a motor coupling part disposed over the blower motor to couple the blower motor to the motor cover.

10. The air conditioner of claim 7, wherein the blower motor comprises a shaft penetrating a lower center of the motor cover to be coupled to the blower fan.

11. The air conditioner of claim 7, wherein the motor cover has a portion thereof inserted into the blower fan.

12. The air conditioner of claim 1, further comprising a plurality of blades disposed between the hub and the shroud, wherein the shroud has an outer circumferential end thereof formed to incline in a direction opposite to a direction of the inlet hole.

13. The air conditioner of claim 12, wherein the hub has an outer circumferential end thereof formed to incline in the direction opposite to the direction of the inlet hole, and a portion of the blower motor is disposed inside the hub.

14. The air conditioner of claim 12, further comprising a filter housing coupled to the blower housing to accommodate a portion of the blower fan.

15. The air conditioner of claim 14, wherein the filter housing comprises a flow guide that has at least a portion of an inner surface thereof corresponding to the shroud formed to incline.

16. The air conditioner of claim 15, wherein the flow guide has an outer circumferential end thereof formed lower than a line straightly extending from an outer circumferential end of the shroud.

17. The air conditioner of claim 14, further comprising a filter assembly inserted into the filter housing and purifying air.

* * * * *